US010271133B2

(12) United States Patent
Anacleto, II et al.

(10) Patent No.: US 10,271,133 B2
(45) Date of Patent: Apr. 23, 2019

(54) ACOUSTIC LENS SYSTEM

(71) Applicants: Concordio C. Anacleto, II, Foster City, CA (US); Michelle Byrnes, San Francisco, CA (US)

(72) Inventors: Concordio C. Anacleto, II, Foster City, CA (US); Michelle Byrnes, San Francisco, CA (US)

( * ) Notice: Subject to any disclaimer, the term of this patent is extended or adjusted under 35 U.S.C. 154(b) by 185 days.

(21) Appl. No.: 15/485,302

(22) Filed: Apr. 12, 2017

(65) Prior Publication Data

US 2017/0303035 A1 Oct. 19, 2017

Related U.S. Application Data

(60) Provisional application No. 62/390,970, filed on Apr. 14, 2016.

(51) Int. Cl.
*H04R 9/06* (2006.01)
*H04R 1/34* (2006.01)
(Continued)

(52) U.S. Cl.
CPC ..... *H04R 1/345* (2013.01); *G10K 11/30* (2013.01); *G10K 11/32* (2013.01); *H04R 7/12* (2013.01); *H04R 5/02* (2013.01); *H04R 9/06* (2013.01); *H04R 9/063* (2013.01); *H04R 9/066* (2013.01); *H04R 2400/03* (2013.01)

(58) Field of Classification Search
CPC . H04R 1/345; H04R 5/02; H04R 7/12; H04R 9/06; H04R 9/063; H04R 9/066; H04R 2400/03; G10K 11/30; G10K 11/32
See application file for complete search history.

(56) References Cited

U.S. PATENT DOCUMENTS 6,031,920 A 2/2000 Wiener
6,243,476 B1 6/2001 Gardner
(Continued)

OTHER PUBLICATIONS

Dayton Audio Tech Note: Understanding Exciters—Principles and Applications; www.daytonaudio.com; Springboro, OH; author unknown; Apr. 21, 2014.
(Continued)

*Primary Examiner* — Brian Ensey

(57) ABSTRACT

An acoustic lens system comprises one or more speakers and a substrate. The speaker comprises a driver capable of receiving an audio signal and a wave forming member in communication with the driver and having a sloped surface. The speaker is adapted to abut the substrate. In use, the driver causes translation of the wave forming member in response to the audio signal. The translation of the wave forming member causes the sloped surface to generate an audio waveform that extends in a direction divergent to the direction of translation. The speaker also generates forces against the substrate so that a ripple wave is propagated along the substrate. The propagation of the ripple wave is projected perpendicularly at a location on the substrate to generate a sound wave from the substrate. The sound wave generated by the ripple wave and the divergently extending wave from the wave forming member intersect at a position away from the speaker thereby creating an immersive sound experience for the user.

19 Claims, 7 Drawing Sheets

(51) Int. Cl.

| | |
|---|---|
| ***G10K 11/30*** | (2006.01) |
| ***H04R 7/12*** | (2006.01) |
| ***G10K 11/32*** | (2006.01) |
| *H04R 5/02* | (2006.01) |

(56) References Cited

U.S. PATENT DOCUMENTS

| | | | | |
|---|---|---|---|---|
| 6,862,361 | B2 | 3/2005 | James et al. | |
| 8,391,500 | B2 | 3/2013 | Hannemann et al. | |
| 9,167,344 | B2 | 10/2015 | Choueiri | |
| 9,762,998 | B1 * | 9/2017 | Gore | H04R 1/345 |
| 2017/0006376 | A1 * | 1/2017 | Tan | H04R 1/20 |

OTHER PUBLICATIONS

Edgar Choueiri; Baach 3D Sound (picture only); 3D3A Lab, Princeton University; date unknown.
Zenith Circle of Sound advertisement; www.roger-russell.com/omni/omni.htm; author unknown, date unknown.
David Moulton: A new loudspeaker design; Sausalito Audio Works, Novato, CA; May 29, 2003.
Robert Archer: Sausalito Audio Leverages Acoustic Lens in Speakers; CE Pro; www.cepro.com; Feb. 25, 2009.
Beolab 5 Loudspeaker; Acoustics, Loudspeaker Development & Live Sound; www.mountain-environment.com/acoustics.html; date unknown.
HiWave Technologies: Keeping up with HiWave Technologies; author unknown; date unknown.

* cited by examiner

ACOUSTIC LENS SYSTEM

PRIORITY

The present application claims the benefit of domestic priority under 35 U.S.C. section 119(e) based on U.S. Provisional Patent Application 62/390,970, filed on Apr. 14, 2016, the entirety of which is incorporated herein by reference.

BACKGROUND

Since the advent of stereophonic sound in the first half of the 20th century, audio engineers have been attempting to create illusions of multidirectional audible perception. What originally began as two loud speakers playing two different audio channels has evolved into sophisticated and complicated systems and algorithms that try to create an environment for a user that simulates real life audio through a speaker system. The goal is to provide a user with an immersive experience where they are enveloped by life-like sound.

A typical stereo sound reproduction system is generally made up of two loudspeakers. One loudspeaker is on the left and one is on the right. Each loudspeaker unit is usually made up of an electromagnetic driver assembly commonly called a speaker that generates sound and an acoustic enclosure which serves as a housing for the entire unit. The electromagnetic driver assembly has a moving part, often referred to as a voice coil, which is attached directly to a voice diaphragm. The moving coil is responsive to an electrical signal by moving forward and rearward along its central axis. The electrical signal is translated into motion of the diaphragm. Forward motion of the diaphragm carries with it a volume of air which produces audible sound which is directed towards the listener. The rearward motion of the voice diaphragm and coil assembly also produces sound but is out of phase relative to the sound generated during the forward motion. The sound created during the rearward motion is contained within the enclosure. When appropriately designed, only the sound during forward motion is heard.

Another type of a loudspeaker is an exciter which operates by bending waves. The bending wave application requires an electromagnetic driver but without the typical voice diaphragm found on conventional speakers. The driver's moving coil mechanism is instead mounted on to the back of a board. The board is similar to the loudspeaker diaphragm in that an audio signal causes the voice coil mechanism to move forward and rearward. The front of the board pushes the air towards the listener. The driver, or exciter, can advantageously be mounted inside the wall so it doesn't need an enclosure box so that it can be hidden from plain sight and can save space.

In an attempt to create a sense of spatial presence, loudspeaker designers have developed passive acoustic lenses to divert sound directionality so that a listener can experience omnidirectional sound instead of hearing directly from the speaker. Some acoustic lenses are shaped like a cone where the tip is oriented directly toward the center of a loudspeaker diaphragm at a very close proximity. This setup usually has the loudspeakers facing upwards so the reflected sound to disperse radially in horizontal orientation. The method has been created by Zenith in the Zenith Circle of Sound and by various other companies with designs of their own.

Designing an acoustic enclosure for conventional speakers has proven to be very challenging and typically adds significant amount of volumetric size and complexity. An enclosure is usually needed to isolate the rear facing portion of the electromagnetic driver assembly for sound cancelation purposes. The sound cancelations reduce the loudspeaker's overall efficiency and sound quality. Both conventional loudspeaker type and the bending wave type of technologies share the same drawbacks. As the voice diaphragm or the vibrating plane increase in surface area, the upper frequency of the audio spectrum is greatly reduced. On the other hand, as their surface areas decrease, the lower frequency of the audio spectrum is also greatly reduced. As a result, drivers such as tweeters and or subwoofers are added to the system to extend the audible frequency coverage. However, the added number of drivers also adversely affects the sound quality if the frequency distribution between drivers is not completely seamless.

Both technologies mentioned above when used in a stereo arrangement can deliver quality sound to the listener. However, the sound can only be projected within the left and right regions. The projection results in a confined sound and lacks the ability of presenting the near and far regions relative to the listener's location. Both technologies present a sound image analogous to a two-dimensional photograph of a three-dimensional object.

Passive acoustic lenses of various shapes have also been implemented in sound projections. While the results may present some improvements in sound quality, the application is best suited for optimizing sound dispersion to focus the sound where it is needed. Differentiating sound locations from left, right, near, and far regions is not easily achievable and cannot be achieved with conventional loudspeakers. For example, to get more out of the antiquated loudspeaker technology, the design type that adheres to the concept of projecting sound towards the listener whether directly or indirectly, the BACCH 3D sound system was developed by Professor Edgar Choueiri at Princeton University to address the technology's spatial limitation. This system is made up of filters and is associated with complex computer algorithm and/or apparatus to track the listener's position as a way to tailor the sound through existing stereo loudspeakers. The system is implemented between the media playback device and the loudspeakers to modify certain sound properties of the original recording for crosstalk cancellation. For the intended 3D sound to be fully experienced, the two speakers must also be at a prescribed distance apart and the listener's location or "sweet spot" relative to the speakers is precisely determined using specialized apparatus needed to maintain the 3D sound presentation. This special method of crosstalk cancellation at the signal chain in an audio system along with the necessary apparatus that make adjustments to compensate for listener positioning in order to achieve the intended 3D sound can be a very expensive solution especially for an average consumer.

Therefore, there is a need for a system that can produce more realistic sound imaging. It is further desirable to be able to produce a system that is capable of transmitting a three-dimensional sound presentation in a simple and affordable manner.

SUMMARY

The present invention satisfies these needs by providing an acoustic lens system that generates an improved listening experience of a user.

In one aspect of the invention, an acoustic lens system comprises a speaker comprising a driver capable of receiving an audio signal, a wave forming member in communication with the driver, the wave forming member comprising a sloped surface, and a substrate against which a surface of the speaker is adapted to abut. The driver causes translation of the wave forming member in response to the audio signal, wherein the translation of the wave forming member causes the sloped surface to generate an audio waveform that extends in a direction divergent to the direction of translation. The speaker also generates forces against the substrate so that a ripple wave is propagated along the substrate.

In another aspect of the invention, an acoustic lens system comprises a speaker comprising a driver capable of receiving an audio signal, a wave forming member in communication with the driver, the wave forming member comprising a sloped surface, and a substrate against which a surface of the speaker is adapted to abut. The driver causes translation of the wave forming member in response to the audio signal, wherein the translation of the wave forming member causes the sloped surface to generate an audio waveform that extends in a direction divergent to the direction of translation. The speaker also generates forces against the substrate so that a ripple wave is propagated along the substrate. Propagation of the ripple wave is projected perpendicularly at a location on the substrate to generate a sound wave from the substrate. The sound wave generated by the ripple wave and the divergently extending wave from the wave forming member intersect at a position away from the speaker.

In another aspect of the invention, a method of generating sound comprises providing an audio signal to an acoustic lens system comprising a speaker comprising a driver capable of receiving an audio signal, a wave forming member in communication with the driver, the wave forming member comprising a sloped surface, and a substrate against which a surface of the speaker is adapted to abut. The driver causes translation of the wave forming member in response to the audio signal, wherein the translation of the wave forming member causes the sloped surface to generate an audio waveform that extends in a direction divergent to the direction of translation. The speaker also generates forces against the substrate so that a ripple wave is propagated along the substrate.

In another aspect of the invention, an acoustic lens system comprises a first and second speaker, each speaker comprising a driver capable of receiving an audio signal, a wave forming member in communication with the driver, the wave forming member comprising a sloped surface, and a surface adapted to abut a substrate. Each driver causes translation of a respective wave forming member in response to the audio signal and wherein the translation of the wave forming member causes the sloped surface to generate an audio waveform that extends in a direction divergent to the direction of translation, and wherein each speaker generates forces against the substrate when abutting the substrate so that a ripple wave is propagated along the substrate.

In another aspect of the invention, a method of generating sound comprises providing an audio signal to the acoustic lens system comprising a first and second speaker, each speaker comprising a driver capable of receiving an audio signal, a wave forming member in communication with the driver, the wave forming member comprising a sloped surface, and a surface adapted to abut a substrate. Each driver causes translation of a respective wave forming member in response to the audio signal and wherein the translation of the wave forming member causes the sloped surface to generate an audio waveform that extends in a direction divergent to the direction of translation, and wherein each speaker generates forces against the substrate when abutting the substrate so that a ripple wave is propagated along the substrate.

In another aspect of the invention, a sound-producing speaker capable of serving as an acoustic lens comprises a first driver capable of receiving an audio signal and a second driver capable of receiving an audio signal. A wave forming member is in communication with the first and second drivers and is positioned therebetween, the wave forming member comprising a sloped surface. The drivers cause translation of the wave forming member in response to an audio signal, wherein the translation of the wave forming member causes the sloped surface to generate an audio waveform that extends in a direction divergent to the direction of translation.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to a wave forming system. In particular, the invention relates to an audio system capable of generating an omnidirectional acoustic sound. Although the system is illustrated and described in the context of being useful for generating audible sounds, the present invention can be used in other applications and for forming other wave forms. Accordingly, the present invention should not be limited to the examples and embodiments described herein.

Figure 1A:
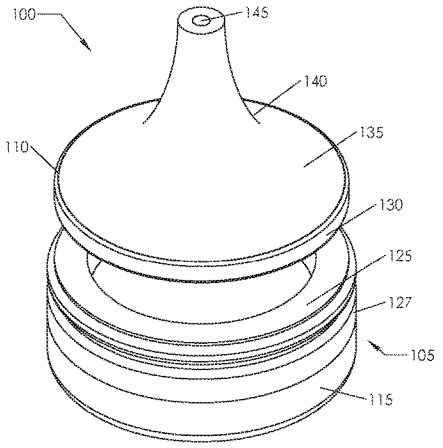
FIG. 1A is a schematic perspective view of a speaker in accordance with one version of the invention.
Figure 1B:
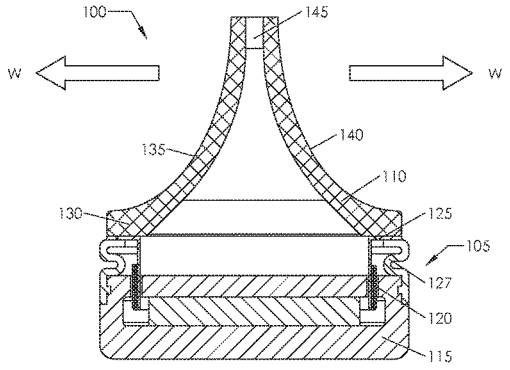
FIG. 1B is a schematic sectional side view of the speaker of FIG. 1A.

An omnidirectional sound-producing speaker 100 according to a version of the invention is shown in FIGS. 1A, 1B, ad 1C. The speaker 100 can serve as an active acoustic lens in that it is capable of generating an acoustic hologram or a three-dimensional sound experience. The speaker 100 is made up of a driver 105, such as an electromagnetic driver, and a wave forming member 110. The driver 105 may be of conventional loudspeaker design and may include a magnetic circuit 115 and a voice coil 120 wound on a bobbin 125. A suspension member 127 provides a mechanical support that keeps the voice coil 120 in the center of its path of excursion and prevents the voice coil 120 from bottoming out and prevents excessive lateral wobble, either of which would cause distortion. The bobbin 125 is attached to or otherwise communicates with the base 130 of the wave forming member 110. The driver 105 receives an electrical signal from an audio amplifier (not shown), and the voice coil 120 moves in response to the signal. In the version shown in FIGS. 1A, 1B, and 1C, the signal would cause the voice coil 120 to move in the up and down direction at a rate that is determined by the signal. The movement of the voice coil 120 causes the bobbin 125 to move which in turn causes translation of the wave forming member 110. The movement of the wave forming member 110 causes air to move and generate a wave in a manner that results in sound.

In one version of the invention, the wave forming member 110 is shaped so that it generates a divergently extending waveform. With a conventional speaker, a generally flat diaphragm would move in an up and down direction and generate unidirectional waves in the up and down direction or in the same direction of movement as the movement of the voice coil 120. However, with the speaker 100 shown in FIGS. 1A, 1B, and 1C, the wave forming member 110 includes a sloped surface 135 that is angled relative to the direction of movement of the voice coil 120. As the wave forming member 110 moves in the up and down direction, the sloped surface causes micro-displacements of air that will generate waveforms that will extend in a direction divergent to the direction of movement of voice coil 120 and the wave forming member 110, as shown by the W in FIGS. 1B and 1C. By divergent it is meant any direction, including multiple directions, wherein at least one direction is not parallel to the direction of movement of the voice coil 120. There may in addition be movement in a direction parallel to the direction of movement of the voice coil 120.

Figure 1C:
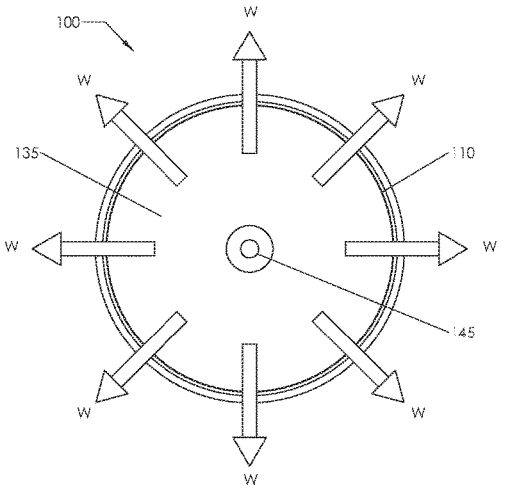
FIG. 1C is a schematic top view of the speaker of FIG. 1A.

The shape of the sloped surface 135 of the wave forming member 110 may take any of a variety of shapes in order to generate a desired divergently directed wave W. For example, the sloped surface 135 may be a surface that is angled from about 10 degrees to about 80 degrees relative to the direction of movement of the voice coil 120. The sloped surface 135 may be a single, flat surface that generates a wave that extends in a single divergent direction or may be two or more flat surfaces that generate waves in two or more divergent directions. In one version, such as the one shown in FIGS. 1A and 1B, the sloped surface 135 is curved and extends around the wave forming member 110. By being in a generally circular orthogonal cross section of the wave forming member 110, the sloped surface 135 can generate waves that are directed radially outward, as shown in FIG. 1C which is a top view of the speaker 100 having a sloped surface 135 extending around the wave forming member 110. As also shown in the versions of FIGS. 1A, 1B and 1C, the sloped surface may include an arched portion 140. By being arched, the wave forming member 110 is able to add more intensity to the focused beam of sound that is dispersed horizontally as a result of increased overall arc length compared to a straight vertical length with the same height. In one version, the arched portion has a parabolic shape that is used to intensify the wave at a desired focal point. In one particular version, as shown in FIGS. 1A, 1B, and 1C the sloped surface 135 may be both arched and may extend circularly around the wave forming member 110. The wave forming member 110 may also include an inner hollow cavity 145 that may be designed to provide a desired timbre.

Figure 2:
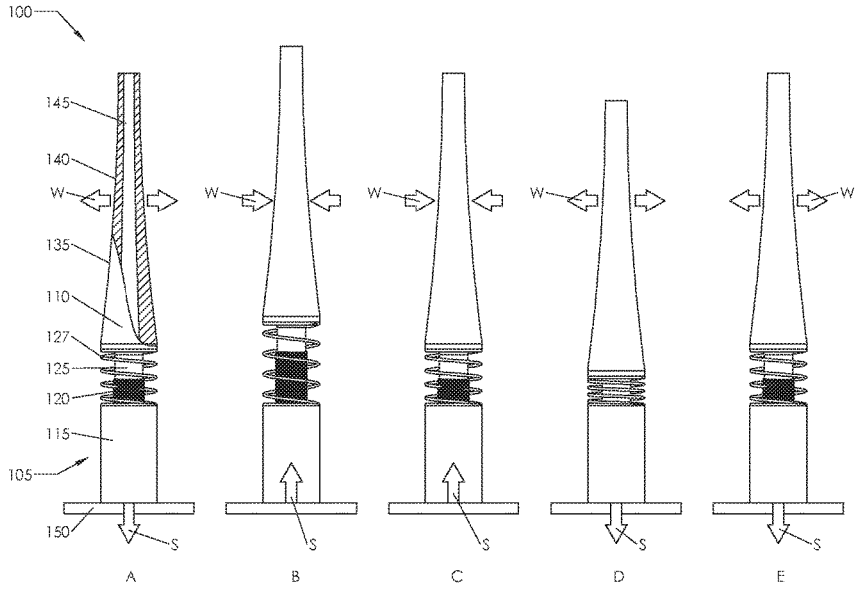
FIG. 2 is a representation of the stepwise operation of the speaker of FIG. 1A.

The formation of waves W by movement of the wave forming member 110 is shown diagrammatically in FIG. 2. Instead of generating a localized sound like conventional speakers, the speaker 100 is designed not to generate omnidirectional sound that puts the user in a more immersive sound environment. Kinetic energy is transferred to the wave forming member 110 by the voice coil 120 and motivates the air radially from the sloped surface 135 of the wave forming member 110. The direction of the wave W represents the kinetic energy transfer from the speaker 100 or acoustic lens system to the surrounding air at the instant that the wave forming member 110 is motivated from its steady state position.

The process of wave generation is illustrated in FIG. 2. FIG. 2 shows a single speaker 100 passing through different stages of sound generation from positions A through E. Positions A through E represent a stepwise progression of how the wave forming member 110 reproduces a full cycle of sine wave audio signal into sound when introduced to the voice coil 120. In position A, an upward force of driver 105 acting on the wave forming member 110 causes micro-compressions along the structural length of the wave forming member 110. The transfer of kinetic energy towards the surrounding air generates sound wave W which is radially dispersed until the point where the maximum positive peak of the sine wave signal is reached. In position B, a downward force of driver 105 pulls back on the structural length of the wave forming member 110 changing the state from micro-compression to micro-expansion thereby causing a rarefaction in the surrounding air and the direction of the sound wave W inwardly as shown. In position C, the downward force continues to pull the wave forming member 110 past the zero position and the rarefaction continues until the maximum negative peak of the sine wave signal is reached. In position D, the onset of the upward force acting on the wave forming member 110 from beneath causes the micro-compressions to re-occur and the sound wave W begins to disperse radially outward. Position E represents the end of one full cycle. The sound wave W at this point continues to disperse radially outward, as shown, should the wave forming member 110 be allowed to continue its course.

The up and down motion of the wave forming member 110 causes the inner hollow cavity 145 to expand and contract volumetrically thereby allowing the air to be inhaled and exhaled. The opening of the inner hollow cavity 145 can be adjusted to produce a desired timbre. Too large of an opening could produce a nasal sound while too small would make the sound more congested. Any engineer proficient in acoustics could easily make the appropriate adjustment depending on the material being used for the wave forming member 110, which may be any suitable material such as wood, plastic, metal, or the like.

As further shown in FIG. 2, in addition to the formation of radially extending waves W, the up and down motion of the wave forming member 110 generates forces that may be transferred downwardly onto a substrate 150 on which the speaker 100 sits or is attached. The substrate 150 may be any table, floor, platform, board, base, box, monitor, flat screen monitor, window, vehicle windshield, ceiling, wall or the like against which the speaker 100 applies a force as it moves in response to the electrical signal. While the wave forming member 110 transmits a wave, such as a sound wave, in a divergent direction, the substrate transmits a substrate wave S in the direction of the movement of the voice coil 120. The substrate 150 reacts to the forces acting on the wave forming member 110 in accordance with Newton's Third Law of Motion. As the driver 105 exerts an upward force against the wave forming member 110, the wave forming member 110 exerts a downward force on the driver 105. Since driver 105 is attached or abuts against the substrate 150, the same downward force is conducted to the substrate 150 at the same time thereby resulting in the propagation of wave S throughout the substrate 150 in the form of a ripple wave L, as shown in FIG. 3A.

Figure 3A:
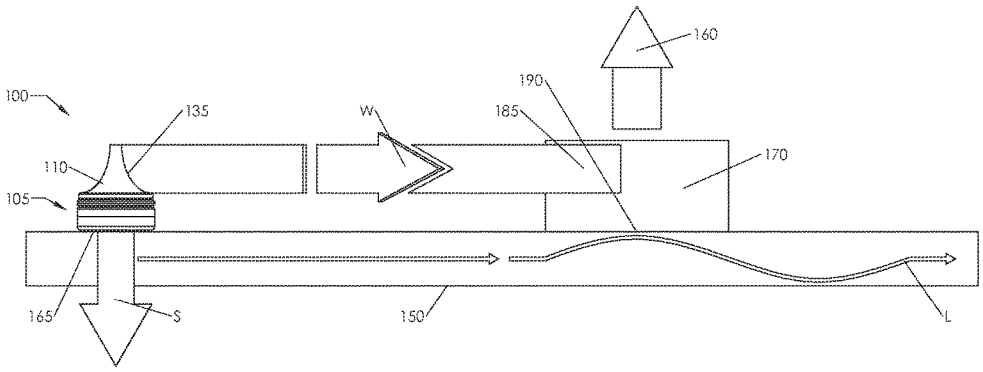
FIG. 3A is a schematic representation of the waves generated by the speaker of FIG. 1A.

FIG. 3A illustrates how the substrate wave S can be used in conjunction with the wave forming member wave W to produce an immersive audio environment. When a speaker 100 receives a signal, the wave forming member 110 is moved in a manner that generates a radially extending wave W, shown as extending in a single direction in FIG. 3A for simplicity. The speaker 100 is in contact with a substrate 150 and the movement of the speaker 100 is conducted to the substrate 150 to generate the substrate wave S (or vibration). The substrate wave S moves up and down perpendicular to the substrate 150 thereby propagating a ripple wave L. A propagation of the ripple wave L will be projected perpendicularly 160 at a location 190 on the substrate 150 and will generate a sound wave 170 in the up and down direction 160. The sound wave 170 generated by ripple wave L and the radially extending wave W from the wave forming member 110 will intersect 185 at a position away from the speaker 110 as prescribed by the characteristics of the original recorded signal sent to the speaker. Intersecting waves that are in phase relative to each other will add up to create a larger wave amplitude while intersecting waves that are out of phase relative to each other create a smaller wave amplitude if not a total cancelation.

The speaker 100 may be affixed to the substrate 150 by a securing means, such as an adhesive 165. In one version, the adhesive 165 may be a soft but strong material, such as gel type or rubber with double sided adhesives, epoxy, or the like. The adhesive can in one version also function as a low pass filter. The thickness of the adhesive 165 may be selected depending on the desired effects and the substrate material. Alternatively or additionally, the securing means may include screws, nails, a weld or the like.

The use of a single speaker 100 as shown in FIG. 3A can be useful particularly when the speaker 100 is playing a recording of a single point event, such as a speech or a violin solo. However, when multiple sounds from multiple points are the subject of the recording, the single speaker 100 system would not be able to simulate the multi-point event. Accordingly, the version of FIG. 3B solves the problem.

Figure 3B:
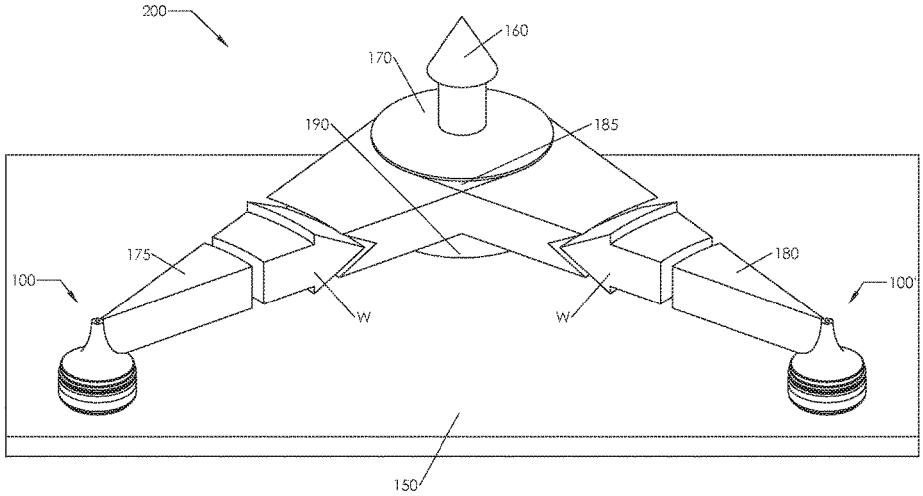
FIG. 3B is a schematic representation of the waves generated by multiple speakers of the type shown in FIG. 1A.

A multidirectional acoustic experience can be even more dramatically enhanced when a system 200 made up of multiple speakers 100, 100' on a substrate 150 is employed. FIG. 3B illustrates a three-dimensional (3D) graphic representation of such a system 200 from a user's point of view with a pair of speakers 100 on a substrate 150 that generate sound energy independent of one another but are used in conjunction with one another. The S and L waves, though present, have been removed from FIG. 3B for diagrammatical clarity. In a conventional speaker system, the sound information from left and right speakers together present a two-dimensional audio image to the user. In contrast, with the present system 200, when the sound is conducted through the substrate 150, a propagation of ripple wave L will be projected perpendicularly 160 at a particular location 190 on the substrate 150. The sound wave 170 is directed upwards and at some distance away instead of towards the listener. The substrate 150 in the version shown in FIG. 3B acts as a conduit to resolve sound information between the speakers 100, 100'. In conventional systems, if more than one sound is generated, pin-pointing each individual sound location can become difficult due to the mixing of sound properties in the air. However, with the system 200, the difficulty in pin-pointing each individual sound location in 3D space can be overcome. The horizontal wave (W) 175 from the first speaker 100 and the horizontal wave (W) 180 from the second speaker 100' interact with a vertical wave 170. The location of the vertical wave 170 is further emphasized or highlighted by both horizontal waves 175 and 180. The resulting sound at the intersection 185 of the three waves is perceived more readily than the sound heard locally from each speaker 100, 100' because of the elevated sound level as a result of combined intersecting waves. Any out-of-phase intersecting waves would be reduced or cancelled out of the acoustic field resulting in a more defined sound presentation. Accordingly, a stereo recording that contains various sound locations that were intentionally panned or distributed within left and right could be faithfully reproduced by the system 200. Furthermore, any stereo recording of sounds placed at various distances (left, right, near, and far regions) as intended by the recording engineer could also be re-created via the substrate 150 by means of a triangulation with ripple waves L to create sound wave 170 while the sweeping horizontal sound waves 175 and 180 create the intersection 185 to further define individual sound location. In one version, the substrate 150 could even simulate an actual stage.

The wave forming member waves W and the substrate waves S will propagate in 360 degrees around the speaker 100. Thus, there is little sound break as a listener moves around the speaker 100 unlike when conventional unidirectional speakers are used. In stereophonic application, the system shown in FIG. 3B is particularly advantageous. Both speakers 100, 100' work together to resolve the original stereo recording. If multiple sounds coming from multiple locations were recorded then the same number of sounds are reproduced to the listener along with their respective locations. Net potential oscillations are generated when two electrical signals in stereo drive the two speakers 100, 101'. The net potential oscillations cause both speakers to generate push-pull mechanical forces (up and down motions) on the substrate 150 and this results in the propagation of impedance field lines. Net potential oscillations are potential differences between two signals but are not converted into another electrical signal. Instead they are translated into net mechanical vibrations riding along the mechanical stereo signal vibrations. The net mechanical vibrations generate the impedance field lines while the stereo signal vibrations travel along a corresponding field line. Both speakers 100, 100' modulate a corresponding local impedance line from each other and re-creates the sound source somewhere along that line. A local impedance line is any of the field lines within the impedance gradient that matches the net stereo sound wave impedance. The impedance gradient generated by net mechanical vibration determines the distance as to how far a particular sound has to float. The stereo signals that modulate a corresponding local impendance line determine the left/right placement of the same sound.

A shifting of the location of an experienced sound can be achieved by local impedance panning and sound shifting. When two speakers 100 generate sound properties with different amplitude-impedance information, a shifted location of the sound is caused. It is common practice in recording studios to reduce the amplitude of one side of a channel and thereby shifting the sound to the other side. Other practices use the Haas effect or the precedence effect method by shifting one side signal to delay the sound wave's arrival time to that the sound waves from the other side arrive first causing the new sound to shift towards the second side.

Figure 4A:
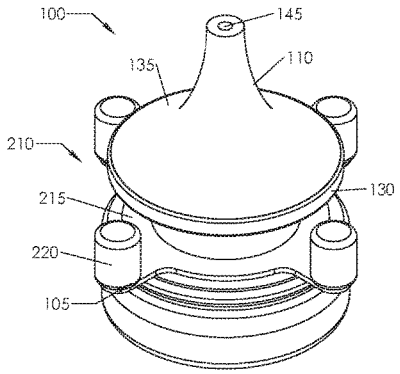
FIG. 4A is a schematic perspective view of another version of a speaker in accordance with the invention.
Figure 4B:
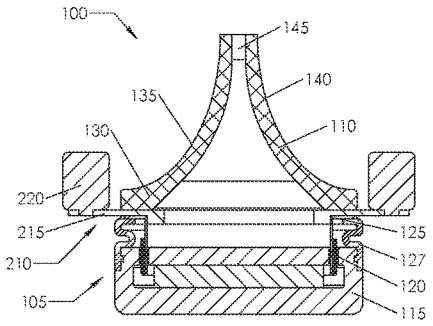
FIG. 4B is a schematic sectional view of the speaker of FIG. 4A.

Another version of a speaker 100 in accordance with the invention is shown in FIGS. 4A and 4B. In this version, between the driver 105 and the wave forming member 110 is a suspension system 210. The suspension system 210, which is separate and independent from suspension member 127, includes a flexible suspension member 215 that suspends the wave generating member 110 and one or more weights 220 that are connected to the flexible suspension member 215. The suspension system 210 acts as a form of a ballast and/or an inertia damper to allow the driver 105 to react freely at high frequencies while the total weights 220 augment low frequency conductions through the substrate 150. As an inertia damper, the suspension system 210 will provide impedance. The wave forming member 110 in this configuration is shaped as a hollow hyperboloid, or a paraboloid when viewed in section.

The amount of weight needed in the suspension system 210 depends on many factors. In one particular version, the mass of the added weight 220 and the wave forming member 110 may be from about 30 grams to about 120 grams. However, if the magnet used in the driver is increased or decreased and/or if the magnetic field used is stronger or lighter, then the mass of the suspension system 210 and wave forming member 110 will correspondingly increase or decrease. Accordingly, in another version, the ratio of the mass of the suspension system, including the added weight 220 and the wave forming member 110 to the max power rating of the driver 105 in watts is preferably from about 1:1 to about 100:1, more preferably from about 2:1 to about 16:1, more preferably from about 4:1 to about 12:1, and most preferably about 8:1.

Figure 4C:
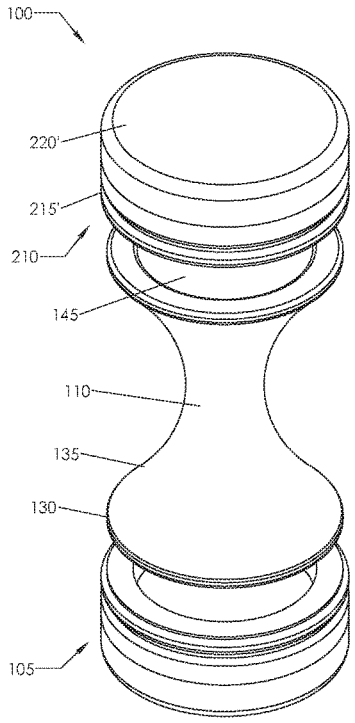
FIG. 4C is a schematic perspective view of another version of a speaker in accordance with the invention.
Figure 4D:
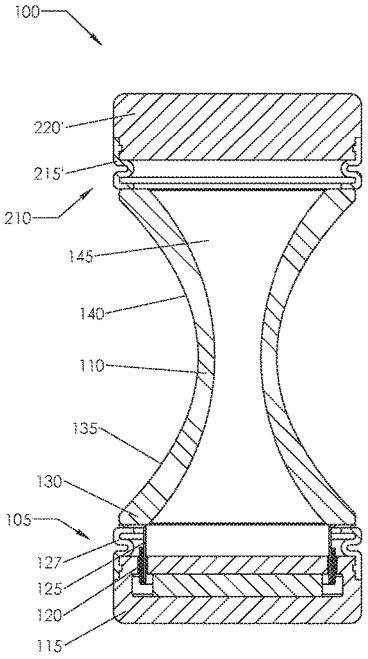
FIG. 4D is a schematic sectional view of the speaker of FIG. 4C.

Another version of a speaker 100 with a suspension system 210 is shown in FIGS. 4C and 4D. In this version, the suspension system 210 is a suspension member 215' and weight 220' mounted above the wave forming member 110. The wave forming member 110 is a hyperboloid (paraboloid in sectional view) and has a geometry similar to previous wave forming members extended to encompass a profile of a full shape, or more particularly both sides, of a parabola. This design further improves the capacity of radiating focussed sound wave W, the top end also allows room for other possible means of controlling sound transmissions. In addition, when at stationary position or when the driver 105 is inactive, the weight 220 of suspension system 210 exerts a constant downward force acting on the wave forming member 110. Thus, wave forming member 110 is squeezed or compressed between the driver 105 and suspension system 210 due to weight 220. The compression further augments a tighter coupling between the driver 105 and the wave forming 110 which in turn improves the kinetic energy transfer.

Figure 5A:
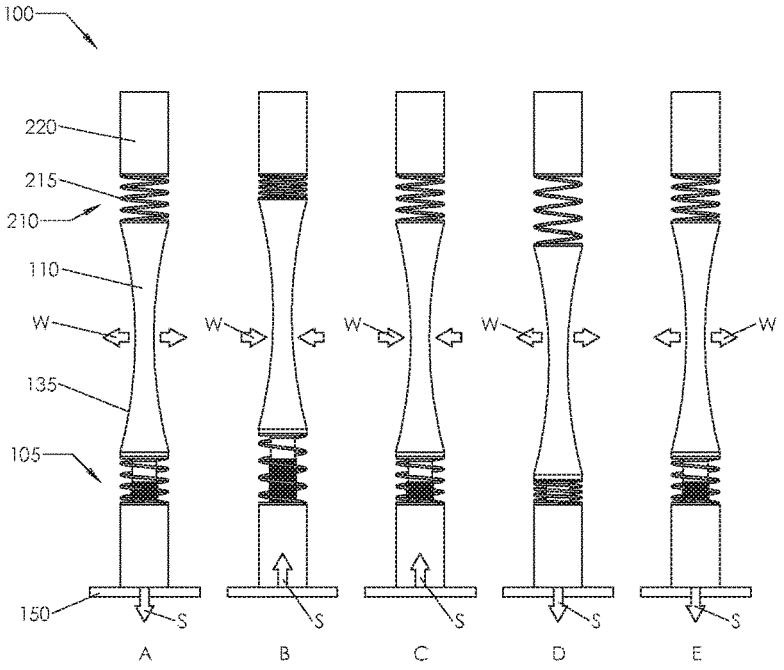
FIG. 5A is a representation of the stepwise operation of the speaker of FIGS. 4A and 4B and of FIGS. 4C and 4D with a high frequency signal.

The operation of the speaker 100 in the version shown in FIGS. 4A and 4B and in FIGS. 4C and 4D is represented in FIG. 5A which depicts a high frequency signal profile and 5B which depicts a low frequency signal profile. During extremely high frequency excursions or high voice coil 120 accelerations, as represented in FIG. 5A, the driver 105 exerts the majority of force against the weight of the wave forming member 110. A fraction of the kinetic energy during a high acceleration is also stored in the suspension system 210 in flexing the suspension member 215. This stored energy is then used to augment the driver 105 on its way back towards the zero position which is also the relaxed position of the suspension member 215 in between up and down motions. While in high frequency excursions, the weight 220 stays in stationary position due to its inertia, and most of the work done by the driver 105 is due to the weight of the wave forming member 110. The resulting high frequency conduction of sound through substrate 150 is due to the light weight of the wave forming member 110 which is advantageous in reproducing a high frequency sound as driver 105 will not be hindered by the weight 220.

Figure 5B:
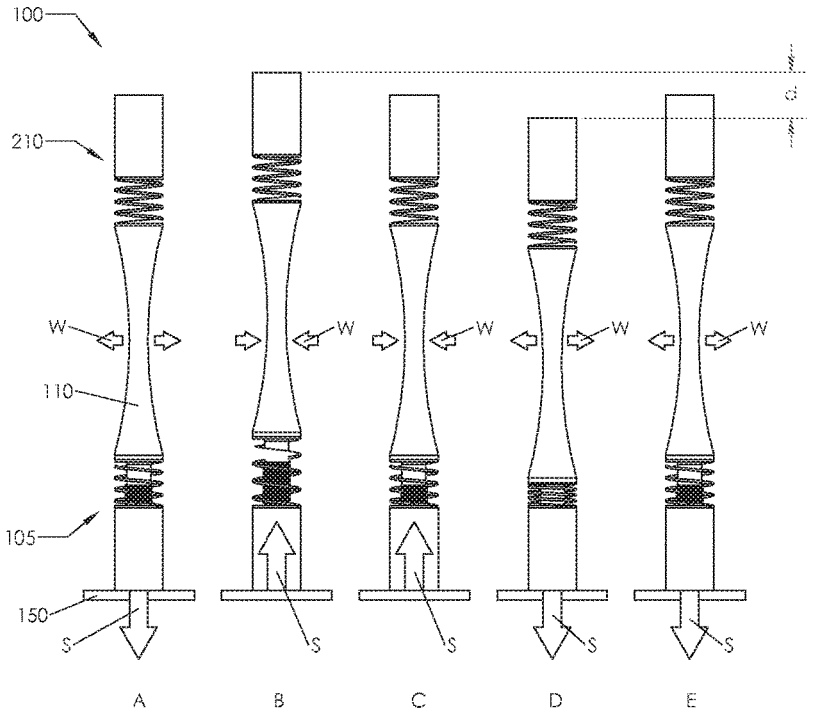
FIG. 5B is a representation of the stepwise operation of the speaker of FIGS. 4A and 4B and of FIGS. 4C and 4D with a low frequency signal.

During extremely low frequency excursions or low voice coil 120 accelerations, as represented in FIG. 5B, the driver 105 exerts the majority of force against the weight of the suspension system 210 including the weight of the wave forming member 110. Also, while in low accelerations, the suspension member 215 will not be sufficiently flexible thereby causing the suspension system 210 to move along with the forming member 110 as one rigid unit. Therefore, the work done by the driver 105 is due to the weight of the suspension system 210 and the weight of the forming member 110. As a result, the conduction of sound through substrate 150 is increased due to the momentum associated with the weight of the suspension system 210 and weight of the forming member 110 which is advantageous in reproducing a low frequency sound.

Thus, as can be seen comparing FIGS. 5A and 5B, assuming a suspension system 210 with negligible resonance frequency, as the signal frequency increases the vertical displacement of weight 220 approaches zero. If the weight 220 has no vertical displacement, the weight 220 does not present a momentum that hinders the sudden changes in the driver's 105 motion. As signal frequency decreases, the vertical displacement of weight 220 approaches the same amount that of voice coil 120 displacement, as shown by d. Since the driver 105 is capable of moving the weight 220 in lower frequencies, the momentum generated by weight 220 that moves along with the wave forming member 110 contributes to the increase in conductions of wave S through the substrate 150. In mid-band audio frequencies, some degree of flexibility of the suspension member 215 in combination with some degree of momentum that the weight 220 presents contribute to the speaker's 100 ability to reproduce a wide audio frequency range. The overall performance of the speaker 100 within the audio frequency range along with an increase in loudness at the same input signal level is further improved with the implementation of the suspension system 210.

Figure 6A:
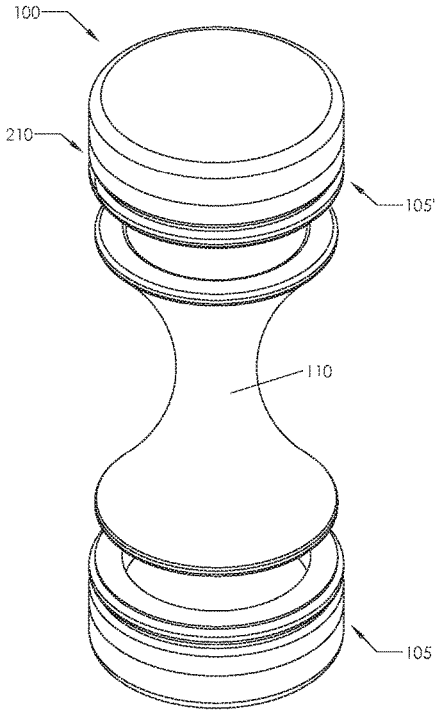
FIG. 6A is a schematic perspective view of another version of a speaker in accordance with the invention.
Figure 6B:
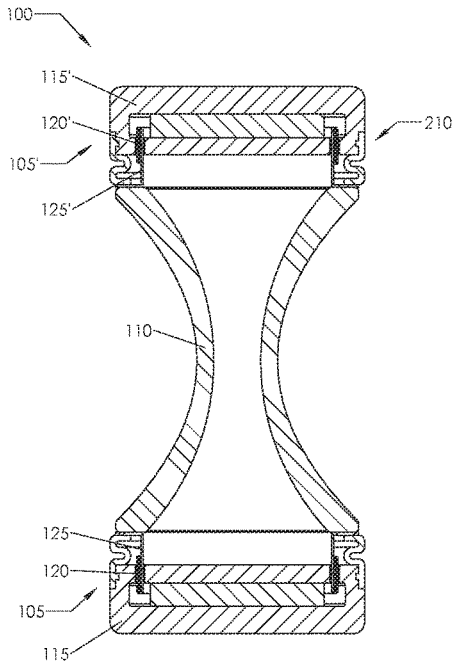
FIG. 6B is a schematic sectional view of the speaker of FIG. 6A.

Another version of a speaker 100 according to the invention for controlling sound transmissions is shown in FIGS. 6A and 6B. In this version, the speaker 100 involves a double ended configuration comprising a first driver 105 as discussed above and a second driver 105' opposed to the first driver 105. The second driver 105' is installed on top of the wave forming member 110. Thus, in this version, the second driver 105' also serves as the suspension system 210 as discussed in connection to the version of FIGS. 4C and 4D. The second driver 105' is employed to perform the task of the suspension system 210 because the driver 105 already has the functional features of the weight 220 and the flexible member 215. The operation of this configuration is similar to what has been discussed above describing the stepwise operation as illustrated in FIGS. 5A and 5B.

In addition to being employed to perform as the suspension system 210, in another version, the second driver 105' can also be operate as a speaker driver and operated together in parallel circuit relative to the first driver 105. By being parallel, both drivers 105, 105' can be wired in the same phase. Accordingly, when the first driver 105 exerts an upward force against the bottom end of the wave forming member 110, the second driver 105' exerts a downward force against the top end of the wave forming member 110. Alternatively, the first driver 105 or the second driver 105' can also be independently driven by a different signal source if so desired to accomplish an intended result such as error correction, sound manipulation, or the like.

The speaker 100 system of FIGS. 6A and 6B produces improved sound output. With the second driver 105' exerting a downward force while at the same time the first driver 105 is exerting an upward force, greater kinetic energy is transferred to the wave forming member 110 causing higher amplitudes of radiated sound waves W. In addition, the overall weight of the second driver 105' that serves as the suspension system 210 contributes to the increase in amplitude of the substrate wave S conducting through substrate 150.

Figure 6C:
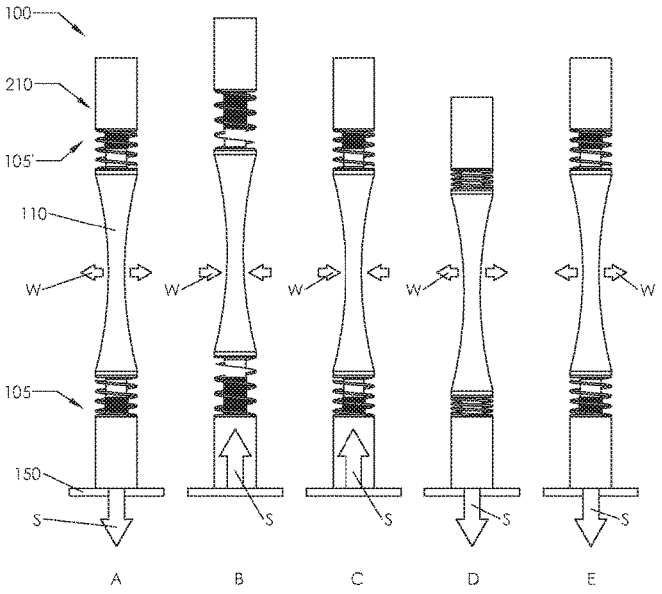
FIG. 6C is a representation of the stepwise operation of the speaker of FIG. 6A.

FIG. 6C shows the stepwise motion of the version of FIGS. 6A and 6B. In position A, just as soon as both the first driver 105 and the second driver 105' exert forces in the direction towards one another as a response to an incoming audio signal, a compression is exerted on the wave forming member 110 and the kinetic energy is translated radially as wave forming member wave W. The net force causes both magnet assemblies 115, 115' to move away from each other as shown in position B. Since the magnetic assembly 115 of the bottom driver 105 is fixed to the substrate 150 while the top and bottom coils 120 and respective bobbins 125 are fixed as one unit with the wave forming member 110 at each end, the magnetic assembly 115' of the second driver 105' will therefore move twice the amount of displacement from its original position, i.e. one relative displacement of bottom voice coil 120 and one relative equal displacement of the top voice coil 120'. In position B, as the audio signal begins to change direction, both drivers 105, 105' will pull from each end of the wave forming member 110 thereby forcibly drawing both magnet assemblies 115, 115' closer toward each other. During this event, the wave forming member 110 will be decompressed or be stretched causing a rarefaction and as a result the kinetic energy transfer reverses direction (inward) as indicated with arrows W. In position C, the motion continues through and past the zero position and the rarefaction continues until the maximum negative peak of the sine wave signal is reached. In position D, as soon as both top and bottom drivers 105, 105' receive another reversal of audio signal, both top and bottom magnet assemblies 115, 115' start to push against the wave forming member 110 at each end causing a compression along the length of wave forming member 110 and the kinetic energy is translated radially with the direction of arrows W. Position E represents the end of the cycle. The compression along the length of the wave forming member 110 causes the sound wave W at this point to continue to disperse radially outward, as shown, should the forming member 110 be allowed to continue its course.

With the bottom electromagnetic driver 105 attached to a substrate 150, a much greater net force is conducted through with this configuration as indicated with wave S as both top and bottom drivers 105, 105' work together. The motion of the wave forming member 110 is due at least in part to the bottom driver 105 that exerts forces (up and down direction). Since the voice coil 120 and the bobbin 125 are coupled directly to the wave forming member 110 as one unit, they move together. When an audio signal is introduced to the voice coil 120, a force is generated that displaces the voice coil 120 from the magnet assembly 115.

Figure 7A:
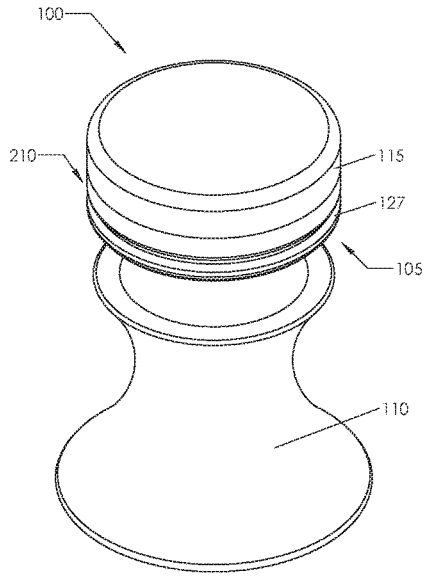
FIG. 7A is a schematic perspective view of another version of a speaker in accordance with the invention.
Figure 7B:
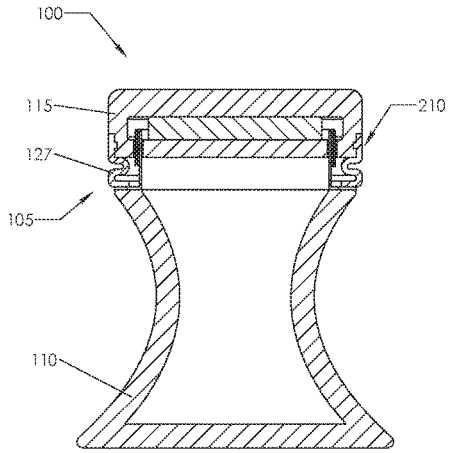
FIG. 7B is a schematic sectional view of the speaker of FIG. 7A.

Another version of the invention is shown in FIGS. 7A and 7B which shows a speaker 100 configured with a stationary wave forming member 110. This version of the speaker 100 includes only one driver 105 which is positioned on top of the wave forming member 110. The wave forming member 110 in this version may be attached directly to the substrate 150 with the audio signal sent to the top driver 105. As shown in FIG. 7A, a top driven speaker 100 is similar to the one described in FIGS. 1A, 1B, and 1C but is oriented upside down and has the attributes described above. The function of the suspension system 210 feature is now executed by the driver 105 since the components that make up suspension system 210 already exist within driver 105. With a stationary wave forming member 110 that is directly coupled with bobbin 125 and coil 120, the magnet assembly 115 becomes the moving part.

Figure 7C:
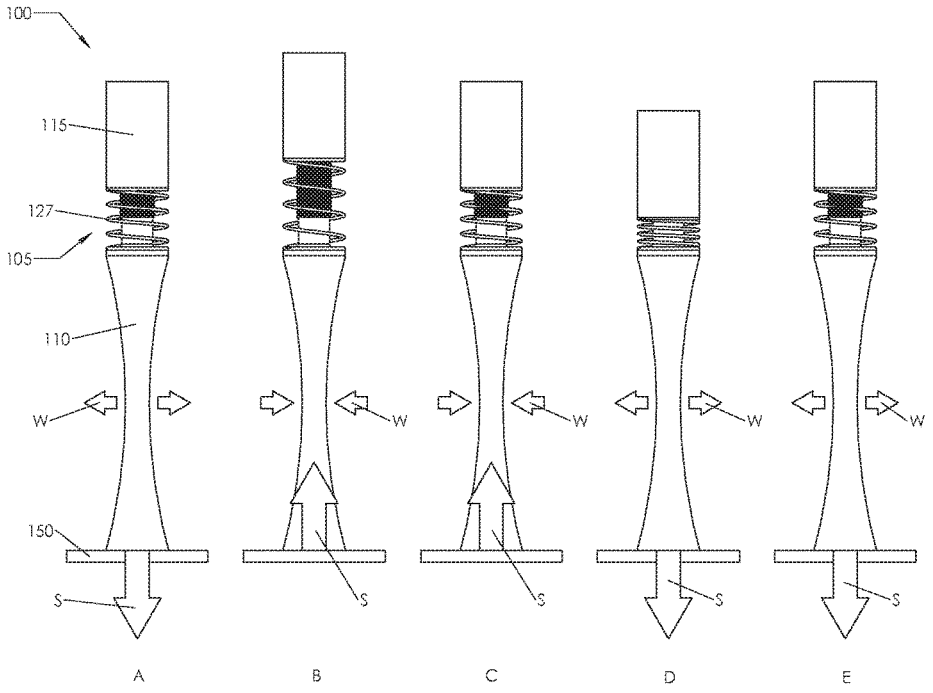
FIG. 7C is a representation of the stepwise operation of the speaker of FIG. 6A.

FIG. 7C illustrates the stepwise position during used of the speaker 100 shown in FIGS. 7A and 7B. In position A, the downward push force of driver 105 acting on the forming member 110 causes a compression along the structural length of the forming member 110 as an impact of an instantaneous force between the voice coil 120 and the magnet assembly 115. As a result, the magnet assembly 115 moves upward. The transfer of kinetic energy towards the surrounding air generates sound wave W which is radially dispersed until the point where the maximum positive peak of the sine wave signal is reached. In position B, the upward pull force of driver 105 pulls back on the structural length of the forming member 110 changing the state from compression to expansion while at the same time pulling back the motion of the magnet assembly 115 that was moving upwards into downwards motion. This causes a rarefaction in the surrounding air hence, the sound wave W is directed radially inwards as shown. In position C, the upward force continues to pull the wave forming member 110 while the magnet assembly 115 continues to be drawn downwards past the zero/original position and the rarefaction continues until the maximum negative peak of the sine wave signal is reached. In position D, the onset of the downward force acting on the forming member 110 from above causes the compression to re-occur and the sound wave W begins to disperse radially outward. Position E represents the end of one full cycle. The sound wave W at this point continues to disperse radially outward, as shown, should the magnet assembly 115 be allowed to continue its course. The downward and upward directions of forces exerted by the driver 105 that conduct through the substrate are illustrated in FIG. 7C as wave S.

The impact of an instantaneous force between the voice coil 120 and the magnet assembly 115, as described above, is not due to collision of moving parts but rather a result of forces between two magnetic fields needed to instantly change the motion of a heavy magnet assembly 115 to a completely opposite direction during a peak swing of an audio signal. The magnet assembly 115, as it moves upward as a result of repelling the voice coil 120, has considerable amount of upward momentum as voice coil 120 is approaching peak positive voltage. The onset of decline in voltage within the coil causes a magnetic force to switch in the opposite direction. At this point the moving magnet assembly 115 performs the function of the suspension weight 220 as its own inertia will maintain its current course. Also at this point, the voice coil 120 along with bobbin 125 are starting to pull on the wave forming member 110 in the same direction as the motion of the magnet assembly 115. Since the wave forming member 110 is immovable and the magnetic force had switched direction, the magnet assembly 115 is forced to move into a downward motion. The opposite occurs as the voice coil 120 reaches past negative peak voltage at the onset of incline in voltage within the coil. While the motion of the magnet assembly 115 is effectively controlled by the continuously changing magnetic field, the sudden changes cause sound energy to develop within the wave forming member 110. The kinetic energy is transferred to the surrounding air that is dispersed radially as sound wave W while the vibration due to the up and down force directions is conducted through the substrate in a form of wave S as illustrated in FIG. 7C.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the cooperating components may be reversed or provided in additional or fewer number. Also, the various features of the versions herein can be combined in various ways to provide additional versions of the present invention. Furthermore, certain terminology has been used for the purposes of descriptive clarity, and not to limit the present invention.

What is claimed is:

1. An acoustic lens system comprising:

a speaker comprising:

a driver capable of receiving an audio signal;

a wave forming member in communication with the driver, the wave forming member comprising a sloped surface; and a substrate against which a surface of the speaker is adapted to abut, wherein the driver causes translation of the wave forming member in response to the audio signal and wherein the translation of the wave forming member causes the sloped surface to generate an audio waveform that extends in a direction divergent to the direction of translation, and wherein the speaker generates forces against the substrate so that a ripple wave is propagated along the substrate.

2. An acoustic lens system according to claim 1 wherein propagation of the ripple wave is projected perpendicularly at a location on the substrate to generate a sound wave from the substrate, and wherein the sound wave generated by the ripple wave and the divergently extending wave from the wave forming member intersect at a position away from the speaker.

3. An acoustic lens system according to claim 1 wherein the speaker is affixed to the substrate by an adhesive.

4. An acoustic lens system according to claim 1 wherein the sloped surface is angled from about 10 degrees to about 80 degrees relative to the direction of translation.

5. An acoustic lens system according to claim 1 wherein the sloped surface comprises a curved surface and extends at least partially around the wave forming member and is designed to generate an audio waveform that is directed radially away from the wave forming member.

6. An acoustic lens system according to claim 1 wherein the sloped surface is arched.

7. An acoustic lens system according to claim 1 wherein the sloped surface comprises a parabolic surface and extends at least partially around the wave forming member and is designed to generate an audio waveform that is directed radially away from the wave forming member.

8. An acoustic lens system according to claim 1 wherein the driver comprises a magnetic circuit, a voice coil and a bobbin, wherein the bobbin communicates with a base of the wave forming member, and wherein the voice coil moves in response to the audio signal and wherein the movement of the voice coil causes the bobbin to move which in turn causes the translation of the wave forming member.

9. An acoustic lens system according to claim 1 further comprising a suspension system that is designed to add weight to the speaker and increase the amplitude of the ripple wave for low frequency signals.

10. A method of generating sound comprising providing an audio signal to the acoustic lens system according to claim 1.

11. An acoustic lens system comprising:

a first and second speaker, each speaker comprising:

a driver capable of receiving an audio signal;

a wave forming member in communication with the driver, the wave forming member comprising a sloped surface; and a surface adapted to abut a substrate, wherein each driver causes translation of a respective wave forming member in response to the audio signal and wherein the translation of the respective wave forming member causes the sloped surface to generate an audio waveform that extends in a direction divergent to the direction of translation, and wherein each speaker generates forces against the substrate when abutting the substrate so that a ripple wave is propagated along the substrate.

12. An acoustic lens system according to claim 11 wherein propagation of the ripple wave is projected perpendicularly at a location on the substrate to generate a sound wave from the substrate, and wherein the sound wave generated by the ripple wave and the divergently extending waves from the wave forming members intersect at a position away from the speakers.

13. An acoustic lens system according to claim 11 wherein the speakers are affixable to the substrate by an adhesive.

14. An acoustic lens system according to claim 11 wherein the sloped surfaces comprise a curved surface and extends at least partially around the wave forming member and is designed to generate an audio waveform that is directed radially away from the wave forming member.

15. An acoustic lens system according to claim 11 wherein the driver comprises a magnetic circuit, a voice coil and a bobbin, wherein the bobbin communicates with a base of the wave forming member, and wherein the voice coil moves in response to the audio signal and wherein the movement of the voice coil causes the bobbin to move which in turn causes the translation of the wave forming member.

16. A method of generating sound comprising providing an audio signal to the acoustic lens system according to claim 11.

17. A sound-producing speaker capable of serving as an acoustic lens, the speaker comprising:

a first driver capable of receiving an audio signal;

a second driver capable of receiving an audio signal;

a wave forming member in communication with the first and second drivers and being positioned therebetween, the wave forming member comprising a sloped surface;

wherein the drivers cause translation of the wave forming member in response to an audio signal and wherein the translation of the wave forming member causes the sloped surface to generate an audio waveform that extends in a direction divergent to the direction of translation.

18. A sound-producing speaker according to claim 17 wherein the sloped surface is designed to generate an audio waveform that is directed radially away from the wave forming member.

19. An acoustic lens system according to claim 17 wherein the speaker is positionable on a substrate wherein the speaker generates forces against the substrate so that a ripple wave is propagated along the substrate, wherein propagation of the ripple wave is projected perpendicularly at a location on the substrate to generate a sound wave from the substrate, and wherein the sound wave generated by the ripple wave and the divergently extending wave from the wave forming members intersect at a position away from the speaker.

* * * * *